US007798715B2

(12) United States Patent
Hefner

(10) Patent No.: US 7,798,715 B2
(45) **Date of Patent: *Sep. 21, 2010**

(54) COMPOSITE BREATHABLE PRODUCE BAG WITH A REINFORCED MESH SIDEWALL

(75) Inventor: Corbett T. Hefner, Antigo, WI (US)

(73) Assignee: Plaspack USA, Inc., Antigo, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/623,540

(22) Filed: Jan. 16, 2007

(65) Prior Publication Data

US 2007/0110341 A1 May 17, 2007

Related U.S. Application Data

(63) Continuation of application No. 09/835,933, filed on Apr. 16, 2001, now Pat. No. 7,163,339.

(51) Int. Cl.
*B65D 30/04* (2006.01)
*B65D 33/10* (2006.01)
*B65D 33/02* (2006.01)

(52) U.S. Cl. ..... 383/117; 383/9; 383/119

(58) Field of Classification Search ..... 383/117, 383/9, 119

See application file for complete search history.

(56) References Cited

U.S. PATENT DOCUMENTS 4,207,983 A * 6/1980 Wolske ..... 206/554
5,741,076 A * 4/1998 Cammack ..... 383/9
6,024,489 A * 2/2000 Fox et al. ..... 383/9
6,030,120 A * 2/2000 Fox et al. ..... 383/9
6,185,908 B1 * 2/2001 Madderom ..... 53/415
6,190,044 B1 * 2/2001 Fox et al. ..... 383/9
6,416,220 B1 * 7/2002 Fox et al. ..... 383/9
6,626,570 B2 * 9/2003 Fox et al. ..... 383/9

(Continued)

FOREIGN PATENT DOCUMENTS

EP 788974 A2 * 8/1997

(Continued)

*Primary Examiner*—Jes F Pascua
(74) *Attorney, Agent, or Firm*—Boyle Fredrickson, S.C.

(57) ABSTRACT

A composite or so-called "half and half" bag has a first side wall formed from a synthetic resin mesh material and a second side formed from a synthetic resin film material. A reinforcing strip extends horizontally along the upper end portion of the mesh side wall of the bag. The reinforcing strip overlaps the upper edge of the first side wall such that it is joined to the first side wall through a horizontal seam positioned well beneath the top edge of the reinforcing strip to form an extension that protrudes well above (e.g., ½ inch to 1½ inches or even more) the upper edge of the mesh side wall. In order to strengthen the seam at the sides of the bag, the side edges of the reinforcing strip are joined to the second film side wall along at least most of the vertical extent of the extension. This film-to-film bond is considerably stronger than a bond through an intermediate mesh layer, as occurs along the remainder of the side seams of the bag. In addition, the relatively long extension provides an improved contact point for suction cups or other equipment used on automated bag filling equipment to open a bag during a bag filling process.

6 Claims, 6 Drawing Sheets

U.S. PATENT DOCUMENTS

| | | | | |
|---|---|---|---|---|
| 6,761,012 | B2 * | 7/2004 | Rusert et al. | 53/410 |
| 6,866,620 | B2 * | 3/2005 | Friedman | 493/210 |
| 6,932,510 | B2 * | 8/2005 | Sway et al. | 383/117 |
| 7,163,339 | B1 * | 1/2007 | Hefner | 383/117 |
| 2001/0019638 | A1 * | 9/2001 | Fox et al. | 383/75 |
| 2002/0068116 | A1 * | 6/2002 | Recchia, Jr. | 426/106 |
| 2004/0032992 | A1 * | 2/2004 | Hershku | 383/9 |
| 2005/0147331 | A1 * | 7/2005 | Sway et al. | 383/117 |

FOREIGN PATENT DOCUMENTS

| | | | | |
|---|---|---|---|---|
| JP | 11130089 | A | * | 5/1999 |
| JP | 2001055244 | A | * | 2/2001 |

* cited by examiner

COMPOSITE BREATHABLE PRODUCE BAG WITH A REINFORCED MESH SIDEWALL

CROSS-REFERENCE TO RELATED APPLICATION

This application is a continuation of U.S. patent application Ser. No. 09/835,933; filed Apr. 16, 2001, entitled "Composite Breathable Produce Bag with a Reinforced Mesh Sidewall" the entirety of which is incorporated by reference herein.

FIELD OF THE INVENTION

The present invention relates to produce bags and, more particular, relates to so-called "half and half" bags having one side formed from an open mesh material and another side formed from a film material. The invention additionally relates to a method of forming a half and half bag and to a method of filling such a bag.

BACKGROUND OF THE INVENTION

A variety of produce bags have been developed for being filled by automatic produce packing machines. Some produce bags also are formed from an open mesh material such as a woven natural or synthetic fiber, a knitted fiber, or a synthetic resin fabric mesh, such as the fabric of cross-laminated synthetic resin fibers known as Cross Laminated Airy Fabric or (CLAF) from BP Amoco. CLAF is an open mesh material of cross-laminated warp and weft strands or fibers of synthetic resin. Open mesh bags are particularly useful for storing produce that must have access to fresh air to preserve the shelf life of the produce.

However, problems have been found to occur when wicket holes are formed in fabric for hanging the bags from pegs or "wicket pins" of automatic produce bag filling purposes. Slits are typically formed in the mesh in the vicinity of the wicket holes. The slits lead away from the wicket holes in order to aid in tearing the bag away from the packing machine once the bag is filled with product. When the mesh fabric is slit for this purpose, only a certain number of synthetic resin fiber strands in the mesh fabric are left uncut. The remaining uncut fiber strands are the sole support for the bag when it is suspended from the wicket pins or pegs and filled with product. The number of strands that remain uncut is variable and indeterminate, and the reliability of the bags for use in automatic packing machines suffers. Bags with too many cut strands do not have adequate strength and tear off from the wickets during filling operations. Bags with an inadequate number of cut threads may fail to pull away from the wickets after the bags are filled.

Another disadvantage of all-mesh bags is that they cannot be printed upon using printing techniques commonly used to print indicia on resin films. Those having a desire to print information on mesh bags therefore often apply a so-called "print band" on the bag to display the desired information.

Composite bags, formed of a synthetic resin mesh sheet and a synthetic resin film sheet, have been proposed. These bags are typically referred to as "half and half bags" because one side or "half" is formed from an open mesh material and a second side or "half" is formed from a clear, tinted, or colored film. It is important to mention that the term "half" does not require that each material must form an equal percentage of the bag's surface area. Indeed, half and half bags can be formed with gusseted sides or four-sided structures, leading to the use of a substantially greater percentage of one of the materials than the other. The mesh sides of half and half bags provide the breathability required of many products, whereas the film side presents a convenient surface for the printing of advertising or other information. Half and half bags having at least some of these characteristics are disclosed, for example, in U.S. Pat. No. 3,257,915, U.S. Pat. No. 6,190,044 (the '044 patent), G.B. Pub. Pat. App. No. 2,309, 956, and J.P. Pub. Pat. App. No. 60-24743. Half and half bags are also commercially available, e.g., from Volm Bag, Inc. of Antigo, Wis. and Kenneth Fox Supply Co. of McAllen, Tex.

Some half and half bags are also configured to be filled by wicketed automatic bag filling equipment. For instance, Volm Bag offers a half and half bag having wicket holes on the film side of the bag. The '044 patent discloses a half and half bag having a film strip on the upper edge of the bag that is configured to have wicket holes formed through it without suffering the drawbacks normally associated with forming wicket holes in a mesh structure. Kenneth Fox Supply Co., the assignee of the '044 patent, offers a similar bag commercially.

Another problem associated with half and half bags is that they tend to have relatively weak side seams because the aggregate joined area between the mesh and the film is relatively small due to the open structure of the mesh. This problem is especially detrimental at the upper end of the bag, which is typically subjected to the greatest stress during bag filling. It is at this location that clamps or other structures physically pull the bag apart to open the bag in preparation for a filling operation. Operation of this equipment imposes considerable stress at the upper ends of the seams. Additional stress is imposed on the seams when the produce or other packaged products fall into the bag from above. Prior half and half bags exhibited substantially higher fill failure rates than similarly constructed all mesh bags or all film bags.

As discussed in the '044 patent, this problem can be partially alleviated by providing a so-called "reinforcing strip" of a resin film on the upper end of the mesh side of the bag. In the configuration proposed in the '044 patent, the upper end of the mesh side of the bag is sandwiched between the reinforcing strip and the film side of the bag, and the three overlapping portions are bonded together. The reinforcing strip disclosed in the '044 patent also extends above the top of the mesh wall of the bag and has wicket holes formed through it for hanging the bag from the wickets of an automatic bag filling machine. According to the text of the '044 patent, the overlapping resin film wall and reinforcing strip fuse directly together at the seams, enclosing the fiber strands between them. This is said to increase the strength of the seams at the upper or top corner portions of the bag.

However, it has been discovered that the problem of side seam weakness is not adequately addressed by the reinforcing strip design of the '044 patent. The reinforcing strip is sealed to the bag's film side wall only along that portion of the bag in which the reinforcing strip overlaps the bag's mesh side wall. In fact, because the upper edge of the bag's film side is coplanar with the upper edge of the bag's mesh side, there is no film material above the upper edge of the bag's film side for the reinforcing strip to bond to. There is no direct film-to-film bond above the upper end of the bag's mesh side. It has been discovered that the resultant seam is relatively weak, possibly due to the fact that sandwiching of the mesh material between the two strips of film material leads to the remnants of relatively large interstices or gaps between adjacent sections of film material, even after the bonding process. Hence, the amount of film-to-film sealing is relatively small. Testing of bags of that type has revealed a relatively high failure rate during bag filling.

Another drawback of the bag disclosed in the '044 patent is that the mesh side wall of the bag is necessarily the rear side wall, i.e., the one having the wicket holes formed therein. The reinforcing strip is not configured to be accessed by suction cups or other devices commonly used to open a bag in preparation for filling. It is believed that the '044 patent stresses this relationship because it is not contemplated that the reinforcing strip can also be used as a suction surface for the suction cups. Instead, it is believed that the '044 patent considers the resin film side wall of the bag to form the only suitable surface for engagement by suction cups. This requirement to form the rear side wall of the bag from the mesh material places limits on diversity of bag design and on the versatility of bag filling processes.

The need therefore has arisen to provide a composite mesh/film bag having relatively strong seams, particularly at the upper ends of those seams.

The need has also arisen to provide a composite open mesh/film bag design that does not necessarily require that the mesh side wall of the bag be the rear side wall.

BRIEF SUMMARY OF THE INVENTION

In accordance with a first aspect of the invention, a synthetic resin bag for use with automatic bag filling equipment includes first and second side walls joined along two side edge portions and a bottom edge portion to form the bag, the first side wall being formed from a synthetic resin mesh material, and the second side wall being formed from a synthetic resin film material. A reinforcing strip of a synthetic resin film extends along an upper edge of the first side wall of the bag. The reinforcing strip has a horizontal length, a vertical width, a bottom edge, a top edge, and a pair of side edges. It overlaps the upper edge of the first side wall such that the reinforcing strip is joined to the first side wall through a horizontal seam positioned well beneath the top edge of the reinforcing strip to form an extension that protrudes well above the upper edge of first side wall, the extension having a vertical width and a horizontal length. The side edges of the reinforcing strip are joined to the second side wall along seams extending at least a majority of a width of the extension, thereby reinforcing the side seams.

The seams preferably extend at least ½" above the upper edge of the first side wall, and even more preferably at least 1½" above the upper edge of the first side edge portion. The large extension provides a relatively large area of a direct film-to-film bond, maximizing the reinforcing effect of the strip.

The extension also provides an ideal surface for engagement with suction cups of automatic bag filling equipment, permitting the use of the mesh side wall of the bag as the front side wall.

Preferably, at least one of the reinforcing strip and the second side wall have wicket holes formed therethrough for mounting the bag on wicket pins of the bag filling equipment.

In accordance with another aspect of the invention, a method of making a produce bag comprises joining a first, synthetic resin mesh side wall to a second, synthetic resin film side wall along side and bottom edge portions of the bag, thereby producing an open-topped bag, positioning a reinforcing strip over the mesh side wall of the bag such that the reinforcing strip vertically overlaps an upper edge of the first side wall to form an extension that protrudes well above the upper edge of first side wall, the extension having a vertical width and a horizontal length, bonding the reinforcing strip to the first side wall along a horizontal seam positioned well beneath a top edge of the reinforcing strip, and bonding the side edges of the reinforcing strip to the second side wall along seams extending at least a majority of a width of the extension.

Preferably, the bag is made by joining a continuous web of a synthetic resin mesh material and a continuous web of a synthetic resin film material together at (1) a first seam extending along a longitudinally extending, lateral edge portion of the web generally corresponding to the bottoms of finished bags, and (2) a plurality of longitudinally-spaced, laterally extending locations corresponding to side edges of finished bags. The reinforcing strip is preferably applied to the bag by positioning a continuous strip of a synthetic resin film material over a longitudinally extending, lateral edge portion of the continuous mesh web corresponding to the upper edges of the finished bags, and joining the continuous strip to the first and second side walls at the longitudinally-spaced, laterally extending locations.

These and other features and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings, in which like reference numerals represent like parts throughout and in which.

DETAILED DESCRIPTION OF A PREFERRED EMBODIMENT

1. Resume

Figure 1:
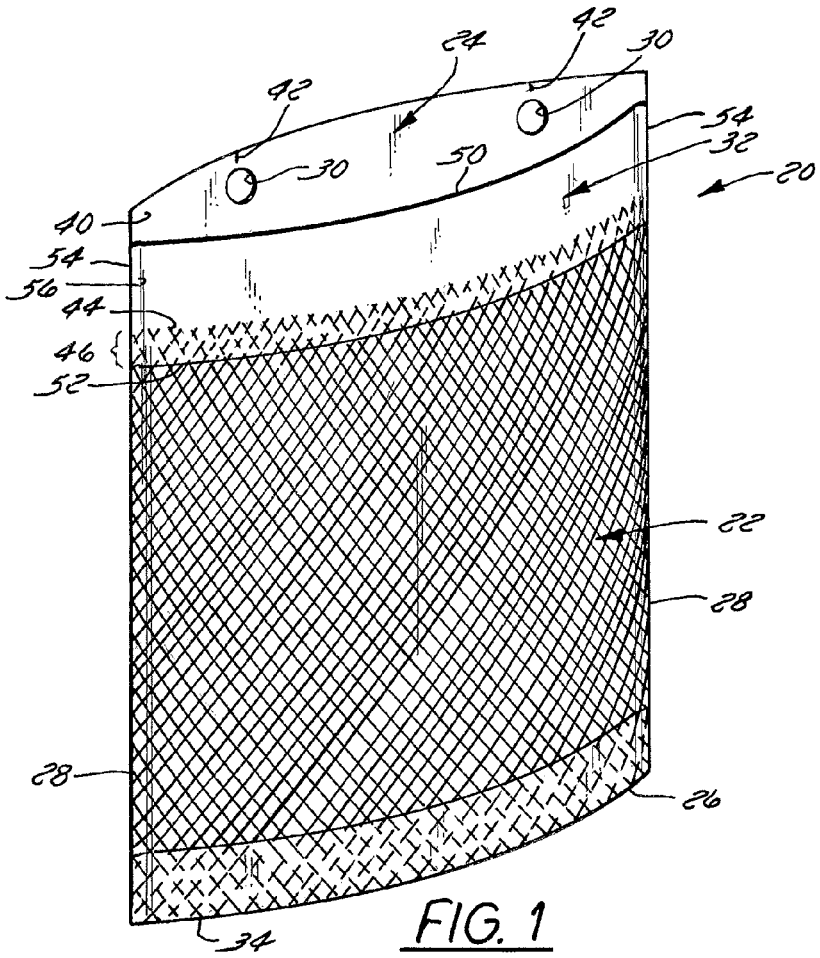
FIG. 1 is a perspective view of a composite bag constructed in accordance with a preferred embodiment of the invention.

Pursuant to the invention, a composite or so-called "half and half" bag is provided having a first side wall formed from a synthetic resin mesh material and a second side formed from a synthetic resin film material. A reinforcing strip extends horizontally along the upper end portion of the mesh side wall of the bag. The reinforcing strip overlaps the upper edge of the first side wall such that it is joined to the first side wall through a horizontal seam positioned well beneath the top edge of the reinforcing strip to form an extension that protrudes well above (e.g., ½" to 1½" or even more) the upper edge of the mesh side wall. In order to strengthen the seam at the sides of the bag, the side edges of the reinforcing strip are joined to the second film side wall along at least most of the vertical extent of the extension. This film-to-film bond is considerably stronger than a bond through an intermediate mesh layer, as occurs along the remainder of the side seams of the bag. The relatively long extension also provides an improved contact point for suction cups or other equipment used on automated bag filling equipment to open a bag during a bag filling process.

2. Bag Construction

Referring to the drawings, and initially to FIGS. 1-5, a bag 20 constructed in accordance with a preferred embodiment of the invention has a first side wall 22 and a second side wall 24 joined together at their bottoms to form an enclosed bottom 26 of the bag. The side walls 22 and 24 are also joined to one another at vertical side seams 28 located at the side edges of the bag 20, hence forming an open-topped bag. Wicket holes 30 may be formed in one of the side walls to permit the bag to be hung with wicket pins of commercially available automatic produce bag filling equipment, available, e.g., from Ag-Pak, Inc. of Gasport, N.Y. or Volm Bag, Inc., of Antigo, Wis. A reinforcing strip 32 is provided at the upper edge of the first side wall 22 to reinforce the upper edges of the side seams 28, thereby inhibiting the seams 28 from splitting during a bag filling operation. The reinforcing strip 32 may also have wicket holes 30 formed therein or may form the contact surface of suction cups of a bag filling machine.

Figure 2:
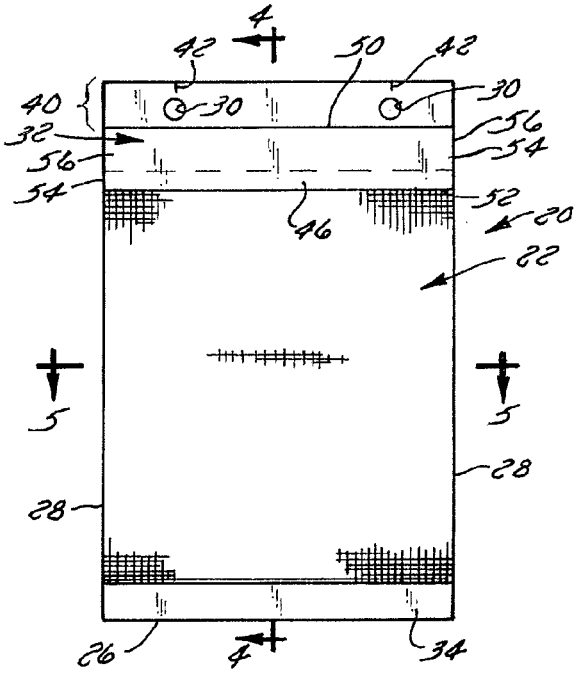
FIG. 2 is a front side elevation view of the bag in FIG. 1.

Referring now to FIGS. 1 and 2, the first side wall 22 of the bag 20 is formed from a suitable synthetic resin fiber mesh. One type of such a mesh is the cross-laminated airy fabric material, or CLAF, available from Bp Amoco. CLAF is an open mesh material of cross-laminated warp and weft strands or fibers of a suitable synthetic resin. Knit, woven, extruded, or scrim mesh materials could also be utilized. If a knit material is employed, it may be one having at least some filaments that are formed from both a low-density material and a high-density material. The two (or more) materials of each such filament could be co-extruded or otherwise formed integrally with one another or could be formed as separate strands which are combined to form a multi-component filament.

Figure 3:
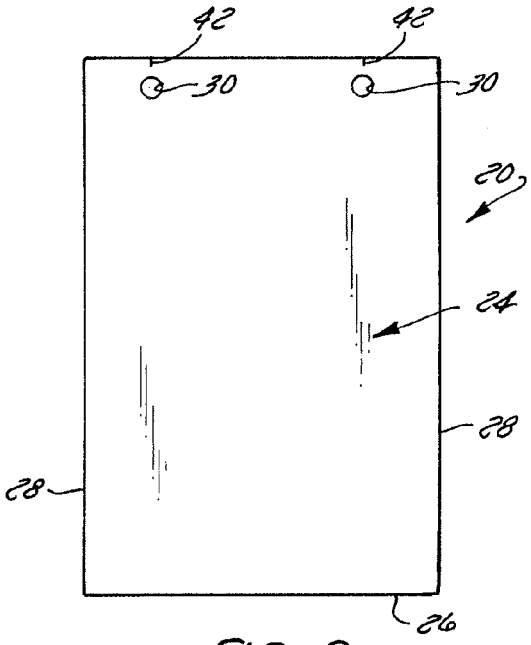
FIG. 3 is a rear side elevation view of the bag of FIG. 1.

Referring now to FIGS. 1 and 3, the second side wall 24 of the preferred embodiment is formed from a suitable synthetic resin film material, such as polyethylene or polypropylene, numerous types of which are commercially available. An example film is 2.25 mil LDPE with an EVA additive. Air or breather holes may be formed in the film material, if desired.

In the illustrated embodiment, the bag 20 is configured to be stacked with other bags on wicket pins of automatic filling equipment to receive and be filled with produce. As will be set forth below, the mesh side wall 22 is the front side wall because it faces outwardly or to the front when the bag 20 is hung on wicket pins, whereas the rear film side wall 24 is the rear side wall that bears wicket holes 30 for hanging the bag 20 from the wicket pins.

The particular horizontal and vertical dimensions of the side walls 22, 24, as well as their thicknesses, are typically determined based on the expected weight and size of produce to be packed into the bag by automatic produce packing machinery. The chart below gives example sizes for bags intended for various produce weights:

| PRODUCE WEIGHT | BAG WALL DIMENSION |
|---|---|
| 2 pounds | 10 inches by 16 inches |
| 3 pounds | 10.5 inches by 16 inches |
| 5 pounds | 10.5 inches by 19 inches |
| 10 pounds | 13 inches by 23 inches |

The vertical side seams 28 may be of any desired width $W_3$ (FIG. 6), depending on holding strength desired for the bag 20 along its vertical side seams. Widths on the order of ⅜" to ⅝" are typical. The joining of the side walls 22 and 24 at seams 28 may be done by any suitable bonding or sealing technique, such as heat, glue, sealant, or the like. Thermal bonding is preferred.

Figure 4:
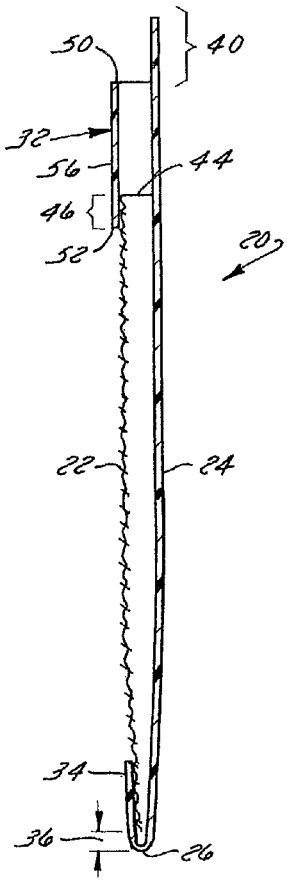
FIG. 4 is a sectional side elevation view taken generally along the lines 4-4 in FIG. 2.
Figure 7:
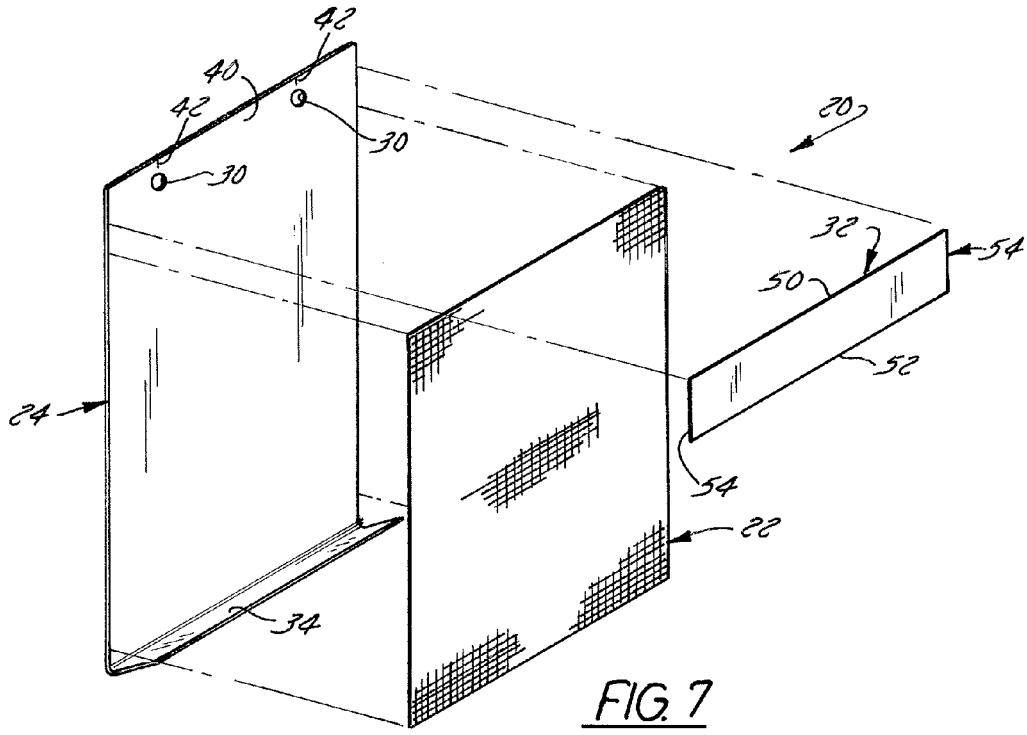
FIG. 7 is an exploded perspective view of the bag of FIGS. 1-6.

Referring to FIGS. 2, 4, and 7, the bottom of the film side wall 24 extends beyond the bottom of the mesh side wall 22 to form a flap 34 which is folded back over the outer surface of the mesh side wall 22 with a small gap 36 being formed between the bottom edge of the mesh side wall 22 and the bottom 26 of the bag 20. Flap 34 is bonded to the mesh side wall 22, but not to the underlying film side wall 24, using any suitable bonding or sealing technique of the type previously mentioned. As a result, the bottom 26 of the interior of the bag 20 is formed from a fold in the film side wall 24 rather than from a seam. This arrangement considerably strengthens the bag 20 and substantially reduces the chances of failure during a bag filing operation because the articles falling into the bag impact against the relatively strong fold as opposed to a relatively weak seam. However, this particular bottom configuration is not critical to the invention. For example, more conventional flush-type seams of the type disclosed, e.g., in U.S. Pat. No. 3,554,368 or bead-type seams of the type disclosed, e.g., in U.S. Pat. No. 3,123,279 could also be utilized.

Figure 4A:
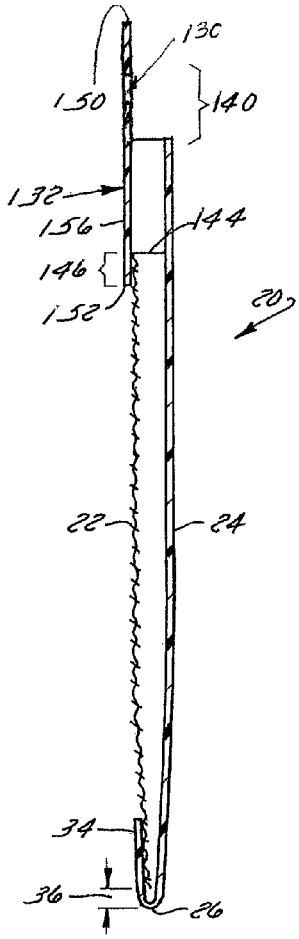
FIG. 4*a* is an alternate embodiment to the embodiment shown in FIG. 4, and as such the reference numerals are incremented by 100.

The wicket holes 30 could be eliminated altogether if the bag 20 is to be filled manually or via bagging equipment lacking wicket pins. However, if they are present, the wicket holes 30 should be arranged to cooperate with wicket pins so as to permit the bag 20 to be suspended in an automatic produce packing machine as it is filled with produce or another product. The size, location, and number of the wicket holes 30 is based upon the nature of the particular bag filling machine with which the bags is to be used. A typical wicket hole is approximately one-half inch in diameter. In the illustrated embodiment in which the mesh side wall 22 forms the front of the bag 20, the wicket holes 30 are formed in a portion 40 of the film side wall 24 that extends above the top of the reinforcing strip 32 (see FIGS. 1, 2, and 4). The portion 40 also could be formed either from a separate strip or integrally with the remainder of the film side wall 24. In an alternate embodiment shown in FIG. 4*a*, wicket holes 130 also could be formed in the reinforcing strip 132, in which case the reinforcing strip 132 would preferably extend above the top of the film side wall 24 of the bag 20. Slits or leaders 42 may be cut above the wicket holes 30 to assist in removal of the bag 20 from the wicket pins of the filling machine once the bag 20 is filled.

The reinforcing strip 32 may be formed from any of a number of suitable synthetic resin film materials. It preferably is formed from the same material as the rear side wall 24. Referring to FIGS. 1, 2, 4, and 6, the reinforcing strip 32 has a horizontal length that equals the width of the bag 20, a vertical width W, a top edge 50, a bottom edge 52, and a pair of side edges 54. The reinforcing strip 32 overlaps the outer surface of an upper edge 44 of the mesh side wall 22 of the bag sufficiently to permit the reinforcing strip 32 to be joined to the mesh side wall 22 through a horizontal seam 46 positioned well beneath the top edge 50 of the reinforcing strip but positioned very near the upper edge 44 of the mesh side wall 22. (It could alternatively be positioned between the walls 22 and 24, in which case it would engage the inner surface of the mesh wall 22.) The vertical width $W_1$ of the overlap need not be any longer than is necessary to permit the formation of an adequate bond between the reinforcing strip 32 and the mesh side wall 22. Since seams are typically on the order of ½" to ⅜" wide, the width $W_1$ of the overlap need not be significantly more than ⅜" to ½". It should be noted, however, that the width of overlap could be considerably greater without departing from the scope of the invention. A wider overlap permits the printing of indicia on the upper portion of the mesh side of the bag.

As a result of the above-described relationship between the reinforcing strip 32 and the mesh side wall 22, an extension 56 of the strip 32 protrudes well above the upper edge 44 of the mesh side wall 22. The horizontal length of the extension 56 is the same as the width of the bag 20. The vertical width $W_2$ of the extension 56 may vary dramatically from application to application. Design factors that should be taken into consideration when choosing the width $W_2$ of the extension 56 include 1) the overall size of the bag 20, 2) the weight of the articles to be contained in the bag 20, 3) the stresses imposed on the side seams 28 of the bag during a bag filling or bag handling operation, and 4) whether or not wicket holes 30 are to be formed in the reinforcing strip 32. The width $W_2$ of the extension 56 typically will be at least ½", and preferably up to 1½" or even more. The extension 56 therefore constitutes much more than 50% of the total width W of the reinforcing strip, and typically constitutes 75% of the width W or more. The relatively wide extension 56 provides a relatively large contact area for suction cups, greatly facilitating a bag filling operation as detailed below.

Figure 6:
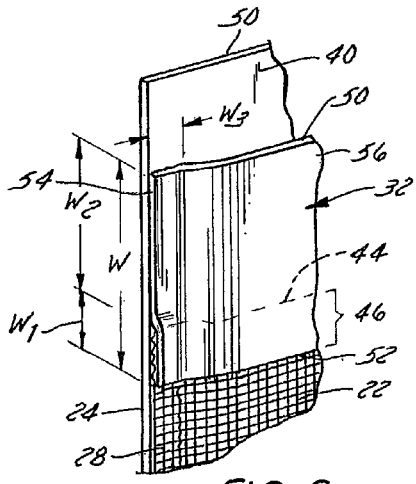
FIG. 6 is a fragmentary enlarged view of a portion of the bag of FIGS. 1-5.
Figure 5:
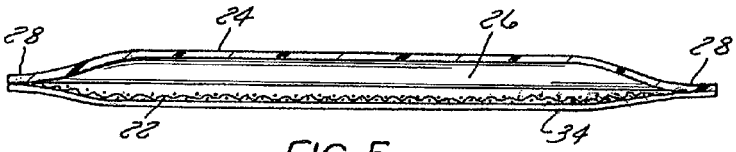
FIG. 5 is a sectional plan view taken generally along the lines 5-5 in FIG. 2.

Referring especially to FIG. 6, the relatively wide extension 56 also provides the opportunity to bond the side edges 54 of the reinforcing strip 32 directly to the film side wall 24 of the bag 20 along seams that extend at least the majority, and preferably all or nearly all, of the $W_2$ of the extension 56. The seams preferably form extensions of the remainder of the side seams 28 of the bag 20 and may be formed at the same time and using the same equipment as the remainder of the side seams 28. The width $W_3$ of the seams also is the same as the width of the remainder of the side seams 28. The width $W_3$ will vary from application to application depending upon, e.g., the equipment used to make the bag 20, the size of the bag, the desired strength of the bag 20. As described more fully below, these seams are extremely strong due to the film to film bonding that forms them.

3. Bag Production Process

The bag 20 as described above could be produced via a variety of manufacturing techniques. It could conceivably be made by hand. However, it is preferably made by a machine that receives rolls of mesh and film material as inputs and that outputs a finished bag 20. Machines capable of producing bags 20 of the type described using roll stock are available, e.g., from Hudson Sharp Machine Co., of Green Bay, Wis. and CMD, Inc., of Green Bay, Wis.

Figure 8:
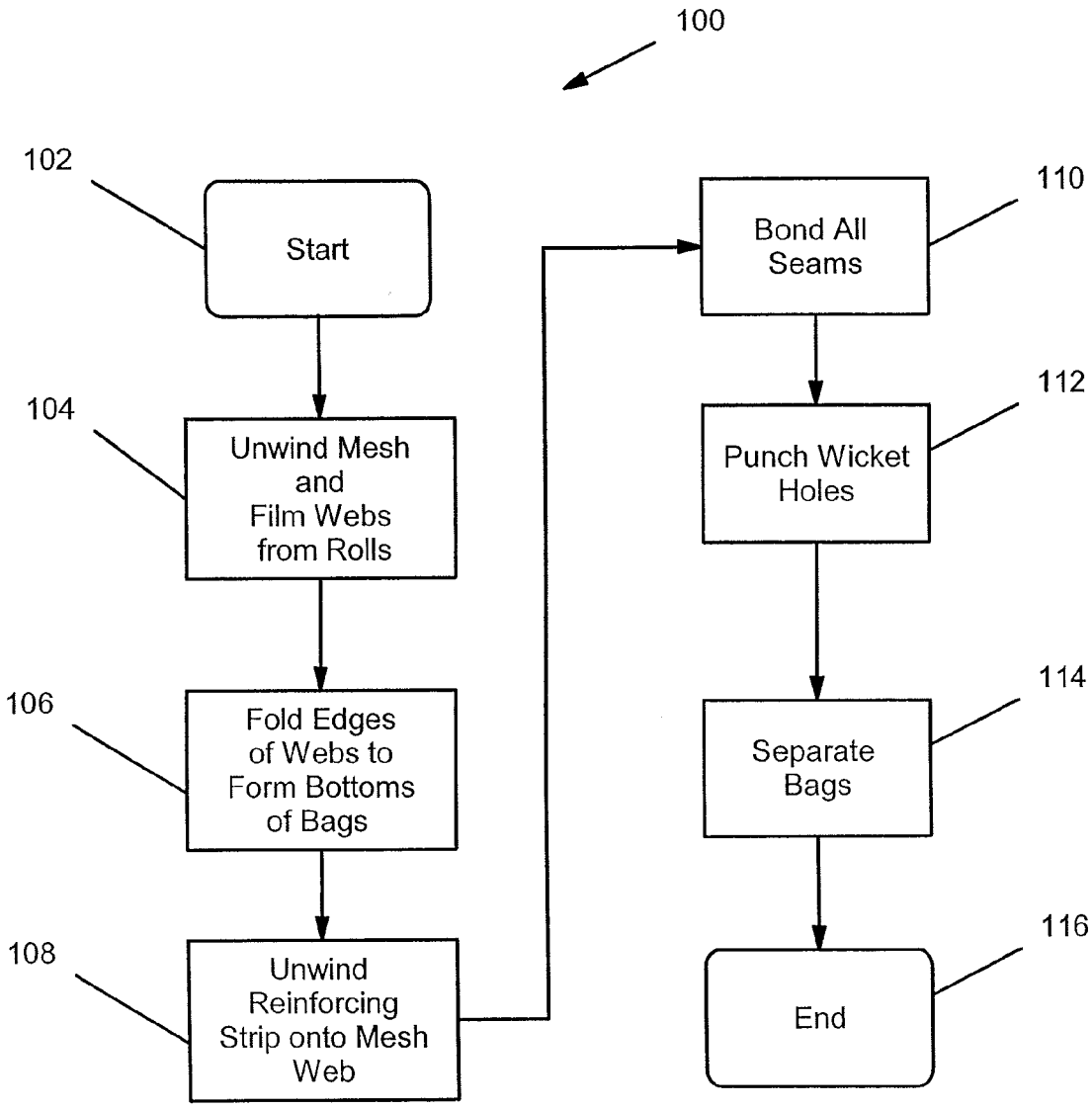
FIG. 8 is a flowchart of a process for forming the bag of FIGS. 1-7.

Referring to FIG. 8, a process 100 of forming a bag using a machine available from one of the above-mentioned manufacturers or another manufacturer begins from START at block 104 and proceeds to block 102, where continuous webs of a synthetic resin mesh material and a synthetic resin film material are unwound from respective rolls. The webs are then fed into the bag making machine proper, typically in the form of two webs running longitudinally through the machine. The webs are oriented such that laterally opposed, longitudinally extending edges of the webs form the top and bottom ends of the bag when the converting process is complete.

Then, in block 106, suitable folding equipment folds one longitudinally extending edge of the film web over an adjacent longitudinally extending edge of the mesh web as the webs are traveling through the machine to form the bottoms of the bags. Then, in block 108, a continuous film strip is unwound from another roll and positioned on top of the other webs such that the film strip overlaps the upper longitudinal edge of the mesh web by the amount illustrated in FIGS. 1, 2, 4, etc. The webs are then bonded to one another at all of the seams in block 110. All bonds preferably are thermal bonds produced by applying heat and pressure at the appropriate locations. The bottom seam is formed by a longitudinally-extending element such as a heated bar or a heated roller assembly. It may be formed simultaneously with or even prior to the folding operation of block 106. The reinforcing strip 32 may be superimposed on and bonded to the mesh web either before or after the film web is folded over and bonded to the mesh web. The side seams 28 are typically formed by intermittently stopping movement of the webs through the machine and pressing a pair of longitudinally spaced, laterally extending heated bars against the webs. The result of this operation is the formation of a continuous strip of bags that are interconnected at their seams. The wicket holes 30 and slits 42 are then formed in the portion 40 of the film in block 112. The holes 30 and slits 42 may be formed in the finished bags 20 or may be formed in the resin web either before or after it is bonded to the mesh web and receives the reinforcing strip 32. The interconnected bags are then separated in block 114 using suitable cutting equipment. The process then proceeds to END in block 116.

4. Process of Filling a Bag

Referring now to FIGS. 9-13, the bag 20 of FIGS. 1-7 is filled using a conventional automated bag filling machine. As mentioned above, suitable machines are available from several sources, including Volm Bag, Inc. of Antigo, Wis. and Ag-Pak, Inc. of Gasport, N.Y. A portion of such a machine 150 is illustrated somewhat schematically in FIGS. 9-13. The machine 150 is conceptually divided into front and rear portions 152, 154, mounted on a common frame 156. The rear portion 154 supports and holds the film side wall 24 of the bag 20. The front portion 152 engages the mesh side wall 22 and pulls it away from the film side wall 24 during a bag filling operation.

The rear portion 154 or the machine 150 includes wicket pins 158 and retaining fingers 160. The wicket pins 158 extend rearwardly from the support frame 156 at an angle so as to receive a stack of bags 20 to be filled. The retaining fingers 160 are pivotable with respect to the frame 156 from a first, retracted position in which they are spaced above the bag 20 to a second, extended position in which they extend into the bag 20 from above and abut the inner surface of the film side wall 24 to prevent side wall 24 from being pulled forwardly away from the wicket pins 158 during bag opening and filling operations.

Figure 9:
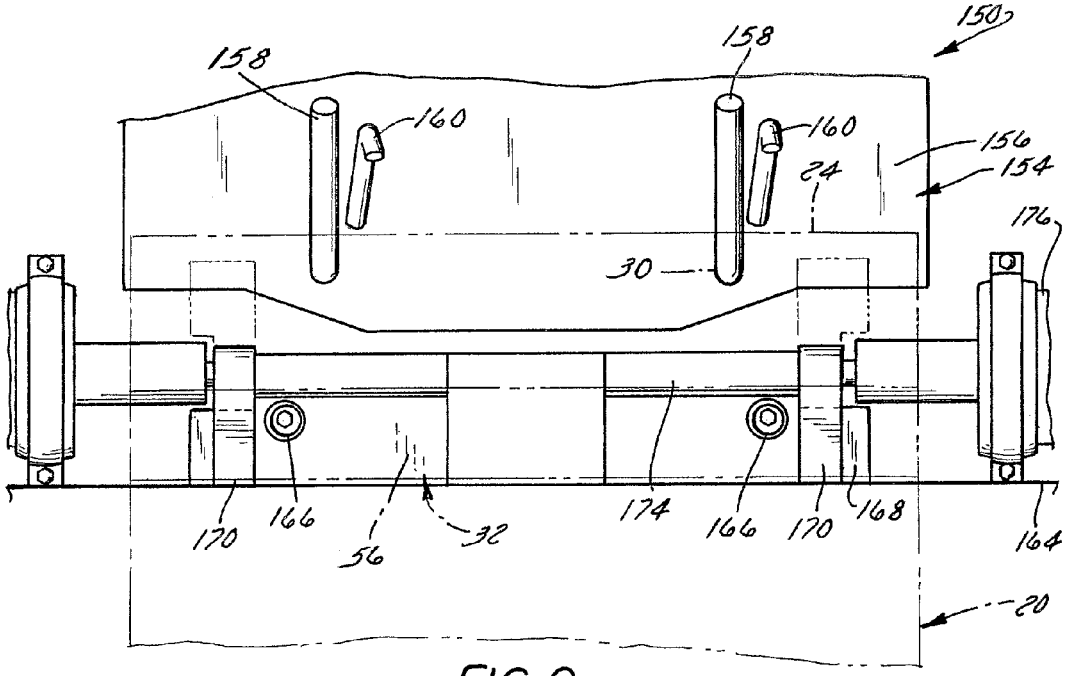
FIG. 9 is a partially schematic plan view of a portion of a bag filling machine usable to fill the bag of FIGS. 1-7.

The front portion 152 of the machine 150 includes a carriage 164 that is mounted on the frame 156 and that bears suction cups 166, a clamp plate 168, and pivoting clamps 170. The carriage 164 is movable along a pair of spaced rods 172 of the frame 156 that extend in parallel with a bag opening direction. The suction cups 166 and clamps 170 are mounted on the rear end of the carriage 164. Two horizontally-spaced suction cups 166 are provided, each of which is aligned with the extension 56 of the reinforcing strip 32 of the first bag 20 in the stack. The suction cups 166 are configured to engage the extension 56 of the reinforcing strip 32 and to draw the mesh side wall 22 of the bag 20 away from the film side wall 24 sufficiently to permit the clamps 170 to swing into their clamping position without interference from the film side wall 24. The clamps 170, best seen in FIG. 9, are mounted on a rotatable shaft 174 that is driven by a rotary cylinder 176 on the carriage 164. Shaft rotation causes the clamps 170 to swing from their retracted position of FIGS. 10-12 to the extended position of FIG. 13 in which they are positioned within the bag 20 and hold the mesh side wall 22 of the bag against the clamp plate 168. A take-away clamp (not shown) may be mounted on another carriage so as to be movable through a U-shaped opening in the center of the carriage 164 to remove the bag 20 from the wicket pins 158 after completion of a bag filling operation. All of these components are typical to wicketed automated bag filling equipment.

Figure 10:
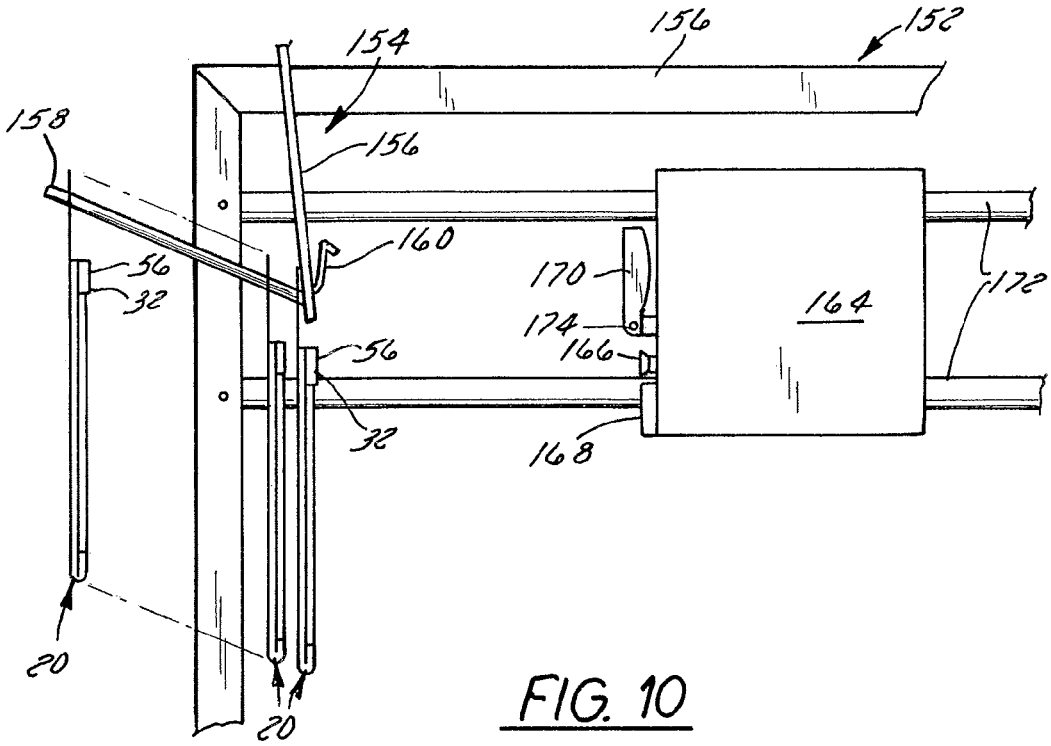
FIGS. 10-13 are somewhat schematic views illustrating a sequence of opening the bag of FIGS. 1-7 using the bag filling machine of FIG. 9.
Figure 11:
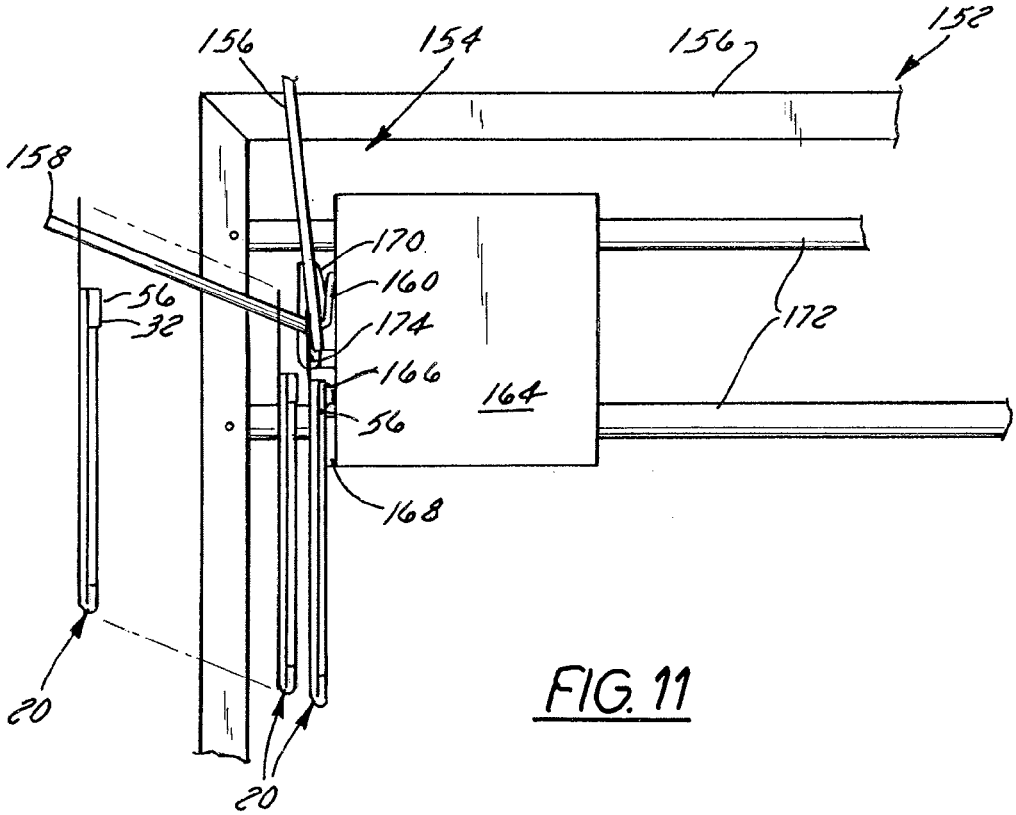

A bag filling operation commences when the carriage 164 is driven along the support rods 172 from its retracted position illustrated in FIG. 10 to its advanced position illustrated in FIG. 11, at which time the suction cups 166 engage or are at least located in close proximity to the reinforcing strip 32 on the first bag of the stack. The vacuum generated by the suction cups then draws the extension 56 of the reinforcing strip 32 of that bag firmly against the suction cups 166. This engagement facilitates operation of the suction cups 166 by permitting the very flexible film of the strip 32 to conform against the faces of the suction cups 166. Significantly less effective contact would be achieved if the suction cups 166 were to contact the reinforcing strip 32 below the extension 56 (or to contact a reinforcing strip lacking an extension) because the underlying mesh structure adds dimensional rigidity to the film that reduces the ability of the film to conform to the shape of the suction cups 166. Moreover, the extended film-to-film seal provided by the reinforcing strip also reduces curl that occurs due to differential thermal contraction of the mesh and film side walls 22 and 24 during the thermal bonding process, resulting in the formation of a more planar surface for engagement by the suction cups 166.

Figure 12:
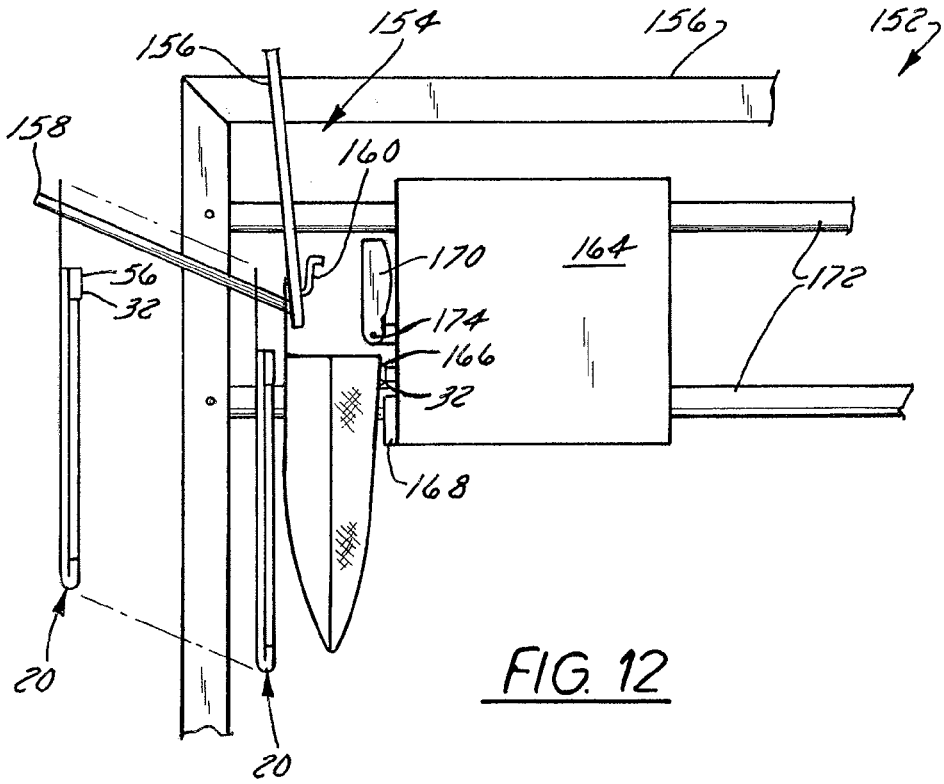

Subsequent carriage retraction moves the bag 20 to a partially open position, as seen in FIG. 12. The clamps 170 then swing from the positions illustrated in FIG. 12 to the position illustrated in FIG. 13 to clamp the mesh side wall 22 against the clamp plate 168. The fingers 160 also swing into the position illustrated in FIG. 13 so as to engage the inner surface of the film side wall 24 and prevent the bag 20 from being pulled away from the wicket pins 158. The carriage 164 then moves further away from the rear portion 152 of the machine 150 to the position illustrated in FIG. 13, at which time the bag 20 is fully opened and ready to receive produce. The side seams 28 of the bag 20, and particularly the uppermost portions of those side seams, are under considerable stress at this time. Those stresses increase when produce or another product to be bagged is dropped into the bag from above. However, unlike prior bags that have relatively weak seams due to the interposition of the mesh between the film side wall and the film strip, the film-to-film seal between the extension 56 of the reinforcing strip 32 and the second side wall 24 sufficiently reinforces the seams 28 to prevent seam failure, or at least dramatically reduce the chances of seam failure under these conditions. In fact, tests of 10 bags constructed as described above revealed that the uppermost ends of the side seams have a seal strength, on average, well in excess of 6.5 lb per linear inch, far exceeding the stresses imposed on such seams in a typical bag filling operation. In contrasts, tests of 10 bags made using the same equipment used to make the inventive bags but having a more conventional suction strip lacking an extension had an average seam strength of less than 4.7 lb per linear inch. Tests on 10 bags of the commercial version of the bag disclosed in the '044 patent revealed even worse results, showing an average seam strength of only about 3.2 lb per linear inch.

The benefits of the improved seam strength were confirmed through fill tests. No side seams failed during fill tests of about 400 5-lb produce bags of various film thicknesses constructed in accordance with the invention. In contrast, during identical tests using the same bag filling equipment, 43 side seams failed during fill tests of about 225 5-lb produce bags of various film thicknesses constructed in accordance with the '044 patent, resulting in a failure rate of about 19%. These same tests revealed that a significant percentage of the bags constructed in accordance with the teachings of the '044 patent suffered wicket hole tears, whereas none of the inventive bags suffered wicket hole tears.

Figure 13:
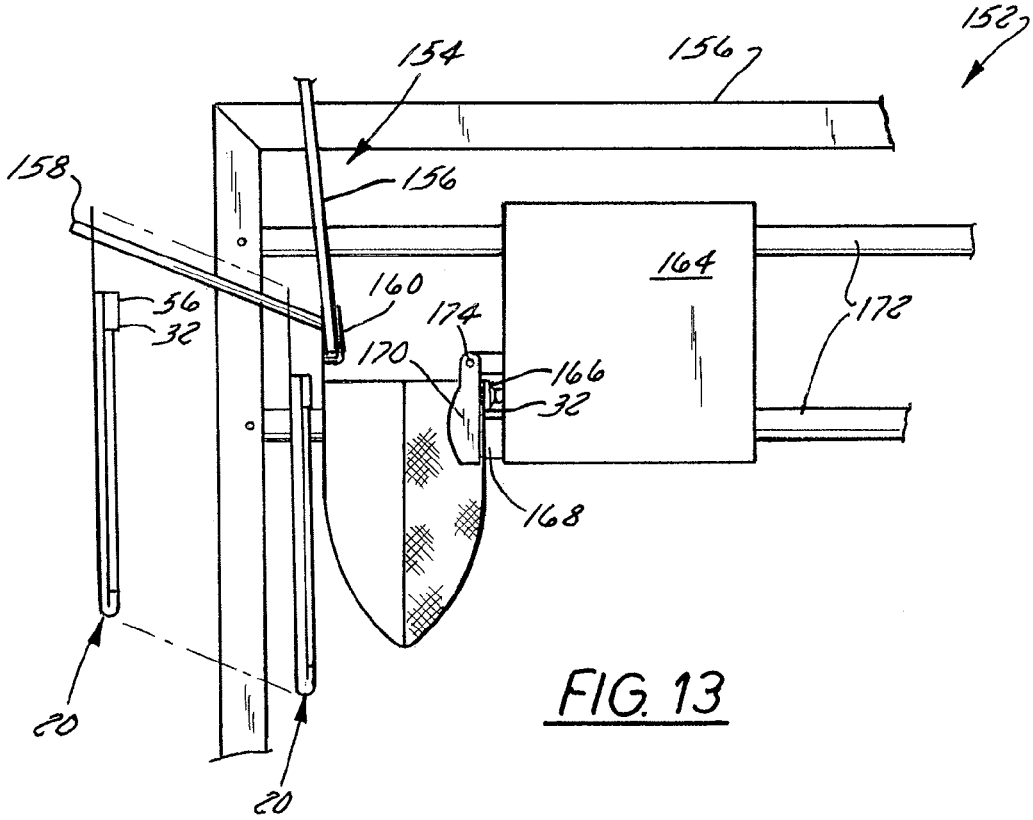

After the bag 20 is fully filled, the clamps 170 and retaining fingers 160 swing from the position illustrated in FIG. 13 to the position illustrated in FIG. 10. The bag 20 can be ripped from the wicket pins 158 using any suitable structure, such as the take-away clamp (not shown) mentioned above. The slits 42 in the film side wall 24 of the bag facilitate ripping of the bag 20 from the wicket pins 158. The improved seam strength provided by the reinforcing strip is particularly beneficial at this time because the seams are subjected to the greatest stress when the bag 20 is ripped from the wicket pins 158. The machine 150 is now ready to fill the next bag in the stack.

Many changes and modifications could be made to the invention without departing from the spirit thereof. For instance, as mentioned above, many beneficial features of the reinforcing strip 32 are applicable to bags configured for use with bagging equipment other than wicket-type bagging equipment. Moreover, if the bag 20 is configured for use with wicket-type bagging equipment, the wicket holes 30 could be placed on the reinforcing strip 32 on the mesh side wall 22 of the bag rather than on the opposite, film side wall 24 of the bag. The side seams 28 and bottom 26 of the bag 20 also could take many configurations than that described above and produced using substantially different equipment than that described and via dramatically different processes. Bags of many different materials, proportions, and overall sizes could also be produced in accordance with one or more aspects of the invention. Other changes will become apparent from the appended claims. From the foregoing, it can be seen that bags are provided which exhibit greater reliability during packing in automatic produce packing machines. The bags offer increased strength in holding produce and are more easily opened for filling. The bags exhibit better capability of staying on the wickets of the machines as produce is being packed. The bags of the present invention are also less likely to suffer from bag material tearing or failure during loading.

I claim:

1. A synthetic resin bag for use with automatic bag filling equipment, the bag comprising:

(A) first and second side walls joined along two side edge portions and a bottom edge portion to form the bag, the first side wall being formed at least in substantial part from a synthetic resin mesh material and at least a majority of the second side wall being formed from a synthetic resin film material, opposed side edges of the first and second side walls being thermally bonded to one another at vertically extending seams; and (B) a reinforcing strip of the synthetic resin film extending along an upper edge of the first side wall of the bag, wherein 1) the reinforcing strip has a horizontal length, a vertical width, a bottom edge, a top edge, and a pair of side edges;

2) the reinforcing strip overlaps and is thermally bonded to the upper edge of the first side wall at a location well beneath the top edge of the reinforcing strip to form an extension that protrudes well above the upper edge of the first side wall, the extension having a vertical width and a horizontal length, and 3) the side edges of the extension are thermally bonded directly to the synthetic resin film material of the second side wall along seams extending at least a majority of the width of the extension.

2. The bag of claim 1, wherein the second side wall is formed entirely from the synthetic resin film material.

3. The bag of claim 2, wherein the synthetic film material also forms a bottom edge of the bag and a bottom end portion of the first side wall of the bag.

4. The bag of claim 1, wherein the reinforcing strip has an uppermost end portion that extends above an upper end of the second side wall of the bag and has wicket holes formed therein.

5. The bag of claim 1, wherein an uppermost end portion the synthetic resin film portion of the second side wall extends above an upper end of the reinforcing strip and has wicket holes formed therein.

6. A synthetic resin bag for use with automatic bag filling equipment, the bag comprising:

(A) first and second opposed side walls thermally bonded to one another along two side edge portions and a bottom edge portion to form the bag, the first side wall being formed at least in substantial part from a synthetic resin mesh material and the second side wall being formed entirely from a synthetic resin film material; and (B) a reinforcing strip of a synthetic resin film extending along an upper edge of the first side wall of the bag, wherein 1) the reinforcing strip has a horizontal length, a vertical width, a bottom edge, a top edge, and a pair of side edges;

2) the reinforcing strip overlaps and is thermally bonded to the upper edge of the first side wall at a location well beneath the top edge of the reinforcing strip to form an extension that protrudes well above the upper edge of first side wall, the extension having a vertical width and a horizontal length, and 3) the side edges of the extension are thermally bonded directly to the synthetic resin film material of the second side wall along seams extending at least a majority of the width of the extension, wherein an uppermost portion of one of the reinforcing strip and the second side wall extends above an upper end of the other of the second side wall and the reinforcing strip and has wicket holes formed therein.

* * * * *